United States Patent [19]

Dorfman

[11] 4,186,641

[45] Feb. 5, 1980

[54] WIRELESS TOY MUSICAL INSTRUMENT

[75] Inventor: Steven R. Dorfman, Fairfield, Conn.

[73] Assignee: Carnival Toys, Inc., Bridgeport, Conn.

[21] Appl. No.: 918,087

[22] Filed: Jun. 22, 1978

[51] Int. Cl.[2] ..... G10H 1/00

[52] U.S. Cl. ..... 84/1.16; 84/DIG. 10

[58] Field of Search ..... 84/1.14, 1.15, 1.16, 84/1.04; 179/1 FS, 146 R

[56] References Cited

U.S. PATENT DOCUMENTS

| | | | |
|---|---|---|---|
| 3,085,460 | 4/1963 | Edwards | 84/1.16 |
| 3,825,666 | 7/1974 | Jaggers | 84/1.16 |

*Primary Examiner*—B. Dobeck
*Assistant Examiner*—Forester W. Isen
*Attorney, Agent, or Firm*—Anthony J. Casella

[57] ABSTRACT

A wireless toy musical instrument, such as a guitar, includes a body member and electronic circuitry disposed within the body for transmitting the output of the musical instrument to a separate receiver such as a standard radio. The circuitry includes an audio section having a sound transducer which converts the audio signal generated by the strings of the guitar to a varying electrical signal comprising either solely a voltage or a combination of voltage and current. The circuitry also includes an oscillator section for generating a carrier signal operating at a predetermined radio frequency, the frequency being set by an LC circuit. The converted audio signal from the transducer is fed into the oscillator, the converted audio signal being combined with the carrier signal. Depending on the type of sound transducer used, a frequency modulation of the carrier signal is effected, either by the change of voltage, or current which is generated by the sound tranducer and applied to the carrier signal. In addition, depending upon the sound transducer used, the internal capacitance of the sound transducer changes also effecting a frequency modulation of the carrier signal. Further, the electrical signal from the sound transducer also effects an amplitude modulation of the carrier signal such that the subject instrument can transmit on either the AM band or FM band.

14 Claims, 5 Drawing Figures

WIRELESS TOY MUSICAL INSTRUMENT

BACKGROUND OF THE INVENTION

The subject invention relates to toy musical instruments, and more particularly to a wireless toy musical instrument, the output of which may be transmitted to a separate receiver means such as a standard radio or a tuner-speaker combination, either on the AM or FM band. While devices for transmitting the output of a musical instrument to a standard radio or tuner-speaker combination exist, said devices have shortcomings that preclude them from being a marketable toy product. For example, known devices generally consist of a stringed musical instrument, such as a guitar, having an inductance type pick-up member disposed directly adjacent the strings of the guitar. The pick-up member is typically a magnetized ferrite bar having a wire coil around it. The movement of the strings adjacent the pick-up member generates a small electric current which, by means of circuitry in the guitar, is transmitted as a radio frequency signal to a nearby receiver means such as a radio. A major shortcoming with such devices as regards their transmission on the FM band lies in the fact that they fail to meet current regulations of the FCC, the agency which regulates the transmission of signals onto standard radios. More particularly, current FCC regulations do not permit the use of an inductance type pick-up member in the transmission of radio frequency signals on the FM band. Of course, without FCC approval, such a device cannot be legally marketed. It will also be appreciated that all such devices, including AM as well as FM transmitters, require that all of the strings of the instrument be metal, a fact that adds to the manufacturing costs of the product, and hurts the viability of the device as a marketable toy item for children.

Accordingly, it is an object of the subject invention to provide a wireless toy musical instrument, the output of which may be transmitted onto a standard radio or tuner-speaker combination, either on the AM band or FM band, which meets current FCC regulations, and which is sturdy, and economical to manufacture.

SUMMARY OF THE INVENTION

In accordance with the above recited objectives, the wireless toy musical instrument of the subject invention includes a body member and means for generating an audio signal disposed on the body member. Typically, the instrument may be a stringed instrument with the means for generating an audio signal being the strings of the instrument. However, in accordance with the subject invention virtually any type of instrument may be used. The subject device further includes a sound transducer means mounted within the body member for receiving the audio signals and converting the signals into electrical signals. Preferably, the sound transducer is a crystal microphone having a high impedance and generating a relatively high voltage output which varies in accordance with the different sounds being generated by the strings of the instrument. In addition, it is preferable that the sound transducer means varies in internal capacitance in proportion to the audio signals received thereby. The subject device further includes circuit means such as an oscillator for generating a carrier signal operating at a predetermined radio frequency, and circuit means for combining the converted audio signal with the carrier signal. The changing voltage generated by the sound transducer combined with the changing capacitance of the sound transducer effects a frequency modulation of the radio frequency signal. In addition, the changing signal generated by the sound transducer effects an amplitude modulation of the carrier signal. Preferably, the means for generating the carrier signal also provides for the radiation of the radio frequency signal to a separate receiver means. The subject device further includes switch means for connecting a power source to the circuitry for powering same. The switch means may typically be a toggle switch, a slide switch, or a rotary switch. In the preferred embodiment of the subject invention, the instrument also includes frequency adjustment circuit means and volume control means. In addition, in the preferred embodiment of the subject invention, at least one of the strings of the subject device is metal and has a length one quarter the wavelength of the predetermined frequency of the carrier signal such that the string operates as an efficient antenna for radiating the generated radio frequency signal to the separate receiver means.

DETAILED DESCRIPTION OF THE PREFERRED EMBODIMENTS

Figure 1:
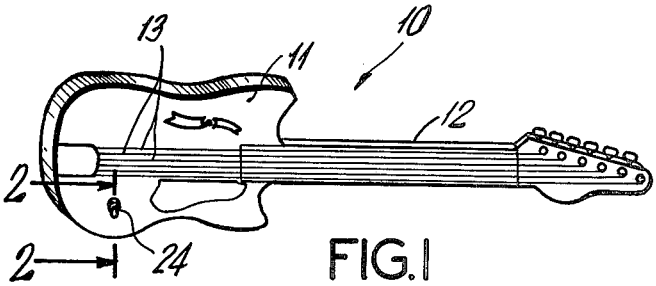
FIG. 1 is a perspective view of the toy musical instrument of the subject invention.

Referring to FIG. 1, there is illustrated a typical toy musical instrument constructed in accordance with the subject invention. While the instrument illustrated in FIG. 1 is a guitar, it will be appreciated that the subject invention is not limited thereto, and that it is intended to cover other types of musical instruments. As illustrated in FIG. 1, the instrument which is designated generally by reference numeral 10, includes a body portion 11 and a neck portion 12 which may be molded from plastic material. Preferably, body portion 11 is of hollow construction. The instrument 10 illustrated in FIG. 1 also includes means for generating a musical sound or audio signal, namely string members 13. In accordance with the subject invention, the strings 13 may be metal as well as a nonconductive synthetic material such as nylon. As will be discussed below, in the preferred embodiment of the subject invention at least one string is metal. Disposed on the outer surface of body portion 11 is a switch member 24 the function of which will be described in detail below.

Figure 2:
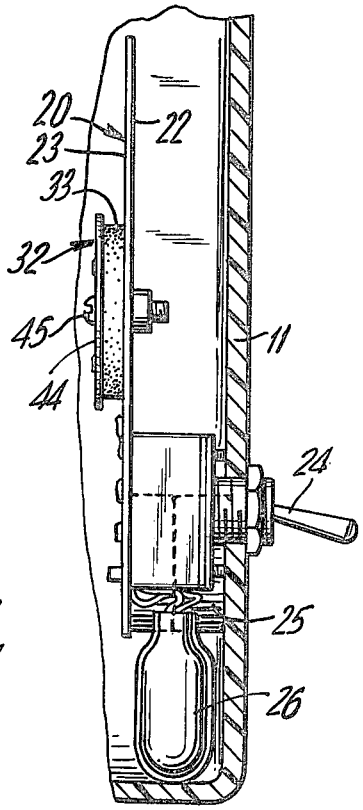
FIG. 2 is a cross sectional view of the toy musical instrument of the subject invention taken along lines 2—2 of FIG. 1.
Figure 3:
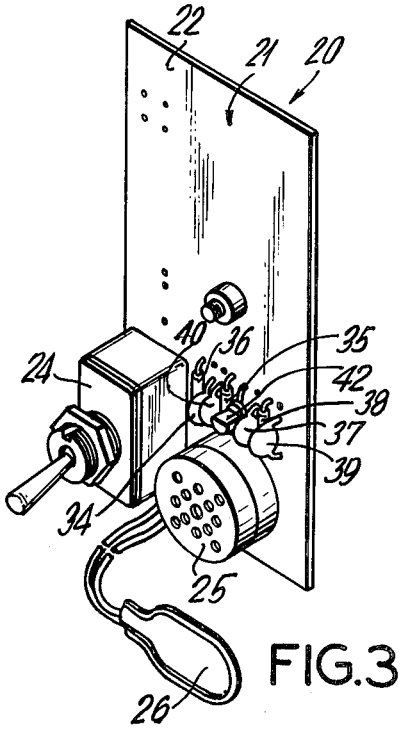
FIG. 3 is a top perspective view of the internal circuitry for operating the toy musical instrument of the subject invention.
Figure 4:
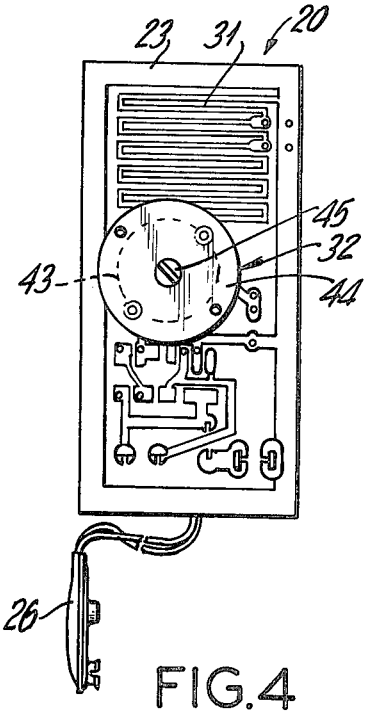
FIG. 4 is a bottom plan view of the circuitry for operating the toy musical instrument of the subject invention.
Figure 5:
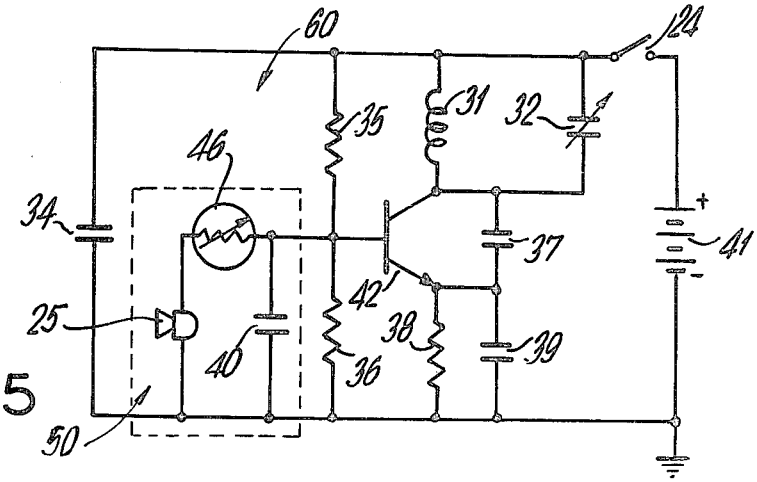
FIG. 5 is a schematic diagram of the electrical circuitry for operating the toy musical instrument of the subject invention.

As indicated above, it is an object of the subject invention to provide a toy musical instrument which is both sturdy in construction and yet relatively inexpensive to manufacture. Further to this objective, the circuitry for operating the toy instrument of applicant's invention, as illustrated in FIGS. 2–4, is contained on a very compact, and inexpensive module 20 which is preferably disposed within hollow body portion 11 of the instrument. It will be appreciated that the circuitry schematically diagramed in FIG. 5 corresponds to the electrical components illustrated in FIGS. 2–4. More particularly, referring to FIGS. 2–4, the module 20 containing the circuitry for operating the toy musical instrument of the subject invention comprises a printed circuit board 21 having an upper face 22 and a lower face 23, the printed circuit board being preferably made from a plastic material. Referring to FIGS. 2–4 in combination with the schematic diagram illustrated in FIG. 5, the circuitry for operating the toy instrument of the subject invention may be broken down generally into an audio section 50 and an oscillator section 60. The audio section 50 of the subject circuitry includes a sound transducer 25 for receiving the audio signals generated by the strings of the instrument and converting said signals to a varying electrical signal. As illustrated most clearly in FIGS. 2 and 3, the sound transducer 25 is preferably disposed within the hollow body portion of the instrument such that it abuts against the inner surface of said body portion to minimize unwanted feedback. In the preferred embodiment of the subject invention sound transducer 25 is a crystal microphone, having a high impedance and generating a relatively high voltage output which varies in accordance with the different sounds received from the strings of the instrument. However, it could also be a magnetic type microphone, a carbon type microphone, or a condenser type microphone. The functions of the different types of sound transducers in conjunction with the subject circuitry will be discussed in detail below. Also part of the audio section of the subject circuitry is a high frequency roll off capacitor 40 which acts as a filter for minimizing high frequency signals.

The oscillator section 60 of the subject circuitry generates a carrier signal having a predetermined radio frequency, and it includes a voltage divider consisting of resistors 35 and 36 which properly maintain the potential of the base of transistor 42 with respect to the other transistor elements. The oscillator section 60 also includes a biasing resistor 38, and a feedback capacitor 37 for stimulating the transistor into oscillation. In addition, the oscillator section includes an LC tank circuit comprising inductor 31 and capacitors 32 and 39 by which the frequency of the carrier signal is determined. Preferably, capacitor 32 is variable such that the frequency of the carrier signal may be changed. Further to the above cited objectives, capacitor 32 and inductor 31 may be constructed in a very economical way. More particularly, as illustrated in FIGS. 2 and 4, capacitor 32 comprises a first plate portion 44, a second plate portion 43, which is actually printed onto the circuit board, and an insulator member 33 disposed between the first and second plate members. Preferably, insulator 33 is a sponge type material, and the entire capacitor is held together by screw means 45. By tightening or loosening screw means 45 the distance between the first and second plate members may be changed, thus varying the capacitance of the capacitor. It will also be noted referring to FIG. 4, that the inductor 31 of the LC circuit may be actually printed onto the printed circuit board, the inductor appearing as a plurality of parallel lines on the under surface 23 of the printed circuit board. Because the inductor 31 is so printed on the printed circuit board rather than being wound as a separate component, each printed circuit board can be made identical to one another, thus insuring substantial uniformity of performance of each toy instrument. In addition to forming a part of the oscillator circuit, inductor 31 provides means by which the RF signal to be transmitted may be radiated to a separate receiver means such as a radio. Moreover, when at least one of the strings 13 of the instrument is metal, the RF signal that is being transmitted by coil 31 is induced into the string of the guitar. Preferably, the string has a length one quarter the wavelength of the frequency of the RF signal. As a result, the metal string acts as an additional antenna, thus improving the transmission of the instrument.

Further referring to FIGS. 2–5, oscillator section 60 also includes switch means 24 for connecting a power source 41 to the circuitry for powering same. Typically, power source 41 is a standard 9 volt battery, which is physically connected to the circuitry by clip member 26. As illustrated in the figures, switch means 24 is a toggle switch. It will be appreciated however, that other switch means could be used, such as a slide switch or a rotary switch. When a rotary switch is employed, it may be desirable to include a volume control member in the subject circuitry. For this purpose, a variable resistor 46 may be included in series with sound transducer 25. Oscillator section 60 further includes a RF bypass capacitor 34.

In operation, switch 24 is placed in the "on" position, thus connecting the battery 41 to the circuitry and initiating the generation of the carrier signal by oscillator section 60. Then, the instrument is played to generate an audio signal. For the stringed instrument 10 illustrated in FIG. 1, the audio signal is, of course, generated by the plucking of strings 13. Sound transducer 25 receives the audio signal from the strings and converts it to a varying electrical signal, which is fed to the base of transistor 42 to be combined with the carrier signal generated by oscillator section 60. As indicated above, when sound transducer 25 is a crystal microphone, the output thereof, (i.e. the electrical signal generated) is in the form of a relatively high voltage which varies in accordance with the different sounds generated by the strings. This varying voltage, when applied to transistor 42 effects a frequency modulation of the carrier signal generated by oscillator section 60. In addition, because the internal capacitance of the sound transducer varies as a result of the different sounds or audio signals received from the strings, further frequency modulation of the carrier signal is effected. Further, the varying electrical signal generated by the different sounds received by the sound transducer from the strings also effects an amplitude modulation of the carrier signal. Thus, the combined signal being radiated by coil 31, has both an AM and FM component enabling the subject instrument to transmit on either the AM or FM bands. It will be appreciated that where AM transmission is desired, the values of the electrical components contained in the subject circuitry will be adjusted so as to generate a carrier signal having a frequency in the AM band, as opposed to the higher frequency required for transmitting in the FM band. In addition, where AM transmission is desired amplification stages between the audio section and oscillator section is preferable. Further, it will be noted that in the preferred embodiment of the subject invention, i.e. when at least one of the strings 13 is metal, and has a length one quarter the wavelength of the signal being radiated by coil 31, that said signal is induced in the metal string such that said string functions as a very efficient antenna.

When the sound transducer 25 is other than a crystal microphone, the output thereof, (i.e. electrical signal generated and fed to transistor 42) is a composite signal comprising a relatively low voltage and a current, both of which vary in accordance with the different sounds received from the strings of the instrument. With these types of transducers, it is primarily the changing current that effects both the frequency and amplitude modulation of the carrier signal.

It should be noted that the above described instrument is designed to transmit the sounds generated by a musical instrument to a standard radio or tuner-speaker combination. However, if so desired, the voice of a person singing while he is playing may also be transmitted. To effect this dual transmission, a second sound transducer may be connected to the subject circuitry in parallel with the first transducer, the second transducer being adapted to be disposed adjacent the mouth of the singer player.

In summary, the subject invention provides a wireless toy musical instrument for transmitting the output thereof to a standard radio, the instrument being very sturdy, simple in construction, and relatively inexpensive to manufacture. Not only is the performance of the instrument quite good, but also, because of its particular construction, each circuit module may be made substantially identical to one another thus, insuring uniform performance of each instrument. Further, because of its particular construction, i.e. it uses a sound transducer rather than an inductance pick up, it meets current FCC regulations thus, making it a marketable toy item.

While there have been described herein what are at present considered preferred embodiments of the invention, it will be obvious to those skilled in the art that many modifications and changes may be made therein without departing from the essence of the invention. For example, although the sound transducer 25 is described as being in abutting relationship with the inner surface of the guitar body, the sound transducer 25 may be adhesively bonded to the inside surface of the guitar body. As such, unwanted feedback signals will be greatly minimized or eliminated, and in addition, the sound transducer 25 will be activated by both the sound emanating from the strings of the guitar, as well as the vibrational forces mechanically transmitted from the guitar body to the sound transducer 25. Alternatively, the sound input portion of the transducer 25 may be covered with adhesive tape or the like to minimize unwanted feedback signals developed within the vicinity of the guitar body.

What is claimed is:

1. A wireless toy musical instrument for transmitting the output thereof to a separate receiver means comprising:

a hollow body member;

non-metallic string means for generating an audio signal disposed on said hollow body member;

sound transducer microphone means for converting said audio signal to a varying electrical signal, said sound transducer means being disposed within and bonded to said body member such that it fixedly abuts against the inner surface of said hollow body member, said sound transducer microphone means generating a voltage output which varies in accordance with the different sounds received from said string means and the vibrational forces mechanically transmitted from said hollow body member to said sound transducer microphone means;

circuit means for generating a carrier signal having a predetermined radio frequency, said circuit means including an LC circuit;

circuit means for combining said varying electrical signal with said carrier signal to effect a frequency modulation and amplitude modulation of said carrier signal; and switch means for connecting a power source to said carrier signal generating means, said inductor of said carrier signal generating means radiating the modulating carrier signal to said separate receiver means for detection and demodulation.

2. A wireless toy musical instrument as recited in claim 1 in which sound transducer means is a crystal microphone in which the internal capacitance thereof changes in accordance with the audio signals received thereby.

3. A wireless toy musical instrument as recited in claim 1 in which the sound transducer means is a magnetic microphone.

4. A wireless toy musical instrument as recited in claim 1 in which the sound transducer means is a condenser microphone.

5. A wireless toy musical instrument as recited in claim 1 in which the sound transducer means is a carbon microphone.

6. A wireless toy musical instrument as recited in claim 1 in which the switch means is a toggle switch.

7. A wireless toy musical instrument as recited in claim 1 in which the switch means is a slide switch.

8. A wireless toy musical instrument as recited in claim 1 in which the switch means is a rotary switch.

9. A wireless toy musical instrument as recited in claim 1 which further includes circuit means for changing the frequency of the carrier signal.

10. A wireless toy musical instrument as recited in claim 9 in which said sound transducer means; said carrier signal generating means; said circuit means for combining the varying electrical signal of said sound transducer with said carrier signal; said circuit means for changing the frequency of the carrier signal; and said circuit means for changing the intensity of the modulated carrier signal, are disposed on a board member.

11. A wireless toy musical instrument as recited in claim 10 in which said circuit means for changing the frequency of the carrier signal is a variable capacitor, having a first plate member printed onto the board and a second plate member separated from said first plate member by a flexible insulator member, said second plate member being movable towards said first plate member.

12. A wireless toy musical instrument as recited in claim 10 in which the inductor of the LC circuit is printed onto the board member as a plurality of parallel conductive line members.

13. A wireless toy musical instrument as recited in claim 1 which further includes circuit means for varying the intensity of the modulated carrier signal.

14. A wireless toy musical instrument as recited in claim 1 which further includes a second sound transducer member connected in parallel with said first sound transducer member whereby one playing the instrument and singing may transmit the sounds of the instrument as well as his voice to said separate receiver means.

* * * * *